US006174215B1

(12) United States Patent
Shih

(10) Patent No.: US 6,174,215 B1
(45) Date of Patent: Jan. 16, 2001

(54) DOUBLE DECK ROTATIONAL MUSIC BOX

(76) Inventor: Barry Shih, 2F, No. 321, Sec. 4, PaTeh Rd., Taipei (TW)

( * ) Notice: Under 35 U.S.C. 154(b), the term of this patent shall be extended for 0 days.

(21) Appl. No.: 09/356,033

(22) Filed: Jul. 16, 1999

(51) Int. Cl.[7] ..... A63H 1/28

(52) U.S. Cl. ..... 446/265; 84/95.1; 84/95.2; 40/410; 446/81; 446/297; 446/298; 446/397; 446/267

(58) Field of Search ..... 446/298, 267, 446/297, 397, 81, 265; 40/410, 411, 409; 84/95.1, 95.2

(56) References Cited

U.S. PATENT DOCUMENTS 3,349,661 * 10/1967 Searls ..... 40/410
5,092,065 * 3/1992 Teng ..... 40/410
5,110,636 * 5/1992 Hou ..... 40/410
5,459,278 * 10/1995 Hou ..... 84/95.1
5,532,422 * 7/1996 Chang ..... 84/95.1
5,705,759 * 1/1998 DeVivo ..... 446/298
5,896,687 * 4/1999 Lo ..... 40/411

* cited by examiner

*Primary Examiner*—Jacob K. Ackun
*Assistant Examiner*—Urszula M. Cegielnik
(74) *Attorney, Agent, or Firm*—Dougherty & Troxell

(57) ABSTRACT

A double deck rotational music box includes a base, a musical kit, a seal cap and a rotational upper cap. A spring knob is located above the base and engages the upper cap. Through turning a spindle and the spring knob, the upper cap and the ornament of the music box may rotate in opposite directions concurrently to produce novel visual and audio amusement effects. The spring knob may be turned easily and safely without turning over the base.

3 Claims, 5 Drawing Sheets

DOUBLE DECK ROTATIONAL MUSIC BOX

BACKGROUND OF THE INVENTION

1. Field of the Invention

This invention relates to a double deck rotational music box and particularly to a double deck rotational music box with an upper deck and a lower deck rotating in opposite direction.

2. Description of the Prior Art

Conventional rotational water ball music box (as shown in FIG. 1) mainly includes a base A, a musical kit B, a seal cap C and a rotationable ornament D. There is a lucid glass ball E filled with liquid inside being placed above the top of the base A. At the bottom of the glass ball E, there is an opening covered by the seal cap C which has a rotational frame F located therein. At the bottom of the rotational frame F, there are a plurality of cavities G. The seal cap C covers the glass opening to form a water tight sealing. The ornament D is fixedly mounted on a top end of the rotational frame F.

The musical kit B is a conventional spring type musical kit which includes a spring knob H, a spindle I, a barrel J, a first gear K and a plurality of screw bores L which enable screws M to fix the musical kit B on the base A. The spring knob H passes through the bottom of the base A and extends under the base bottom. At one end of the barrel J, there is a second gear N axially aligned with the barrel J and engaged with the first gear K. The spindle I has one end attached to the first gear K and another end thereof attached to a driving disk P. Above the driving disk p, there are a plurality of struts Q engageable with the cavities G.

Turning the spring knob H, the barrel J will be rotated to generate music while the second gear N will drive the first gear which in turn rotates the driving disk P, struts Q engageable with the cavities G.

However the ornament D may only make one directional rotation. It makes people bored easily. Furthermore the spring knob H is located under the bottom of the base A. A user has to take and turn the base A to access and turn the spring knob H. It is prone to incur accident or even break the glass ball E. It could easily result in harmful accidents, particularly to children.

SUMMARY OF THE INVENTION

It is therefore an object of this invention to provide a double deck rotational music box that includes a base, a musical kit, a rotational frame and a rotational upper cap. Through installation change of the musical kit and the spindle and spring knob of the musical kit, the rotational frame and the upper cap may rotate in opposite directions concurrently. It thus may create a more amusing visual effect.

It is another object of this invention to provide a double deck rotational music box which has the spring knob located at an upper portion of the base. A user may turn the spring knob easily without taking and turning the base. It thus greatly reduces the risk of breaking the glass ball or creating a harmful accident.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
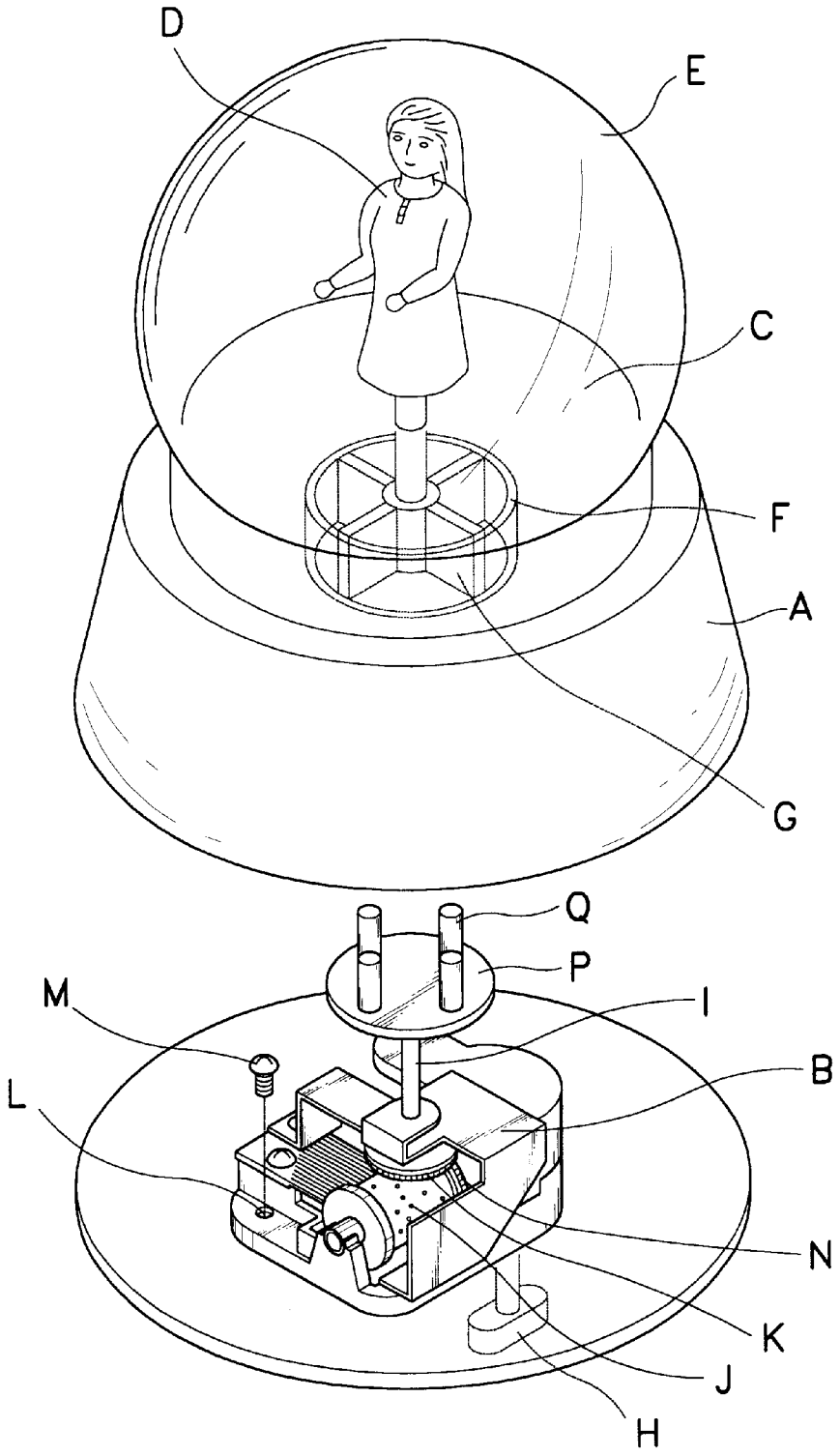
FIG. 1 (PRIOR ART)
FIG. 1 is an exploded perspective view of a conventional music box.
Figure 2:
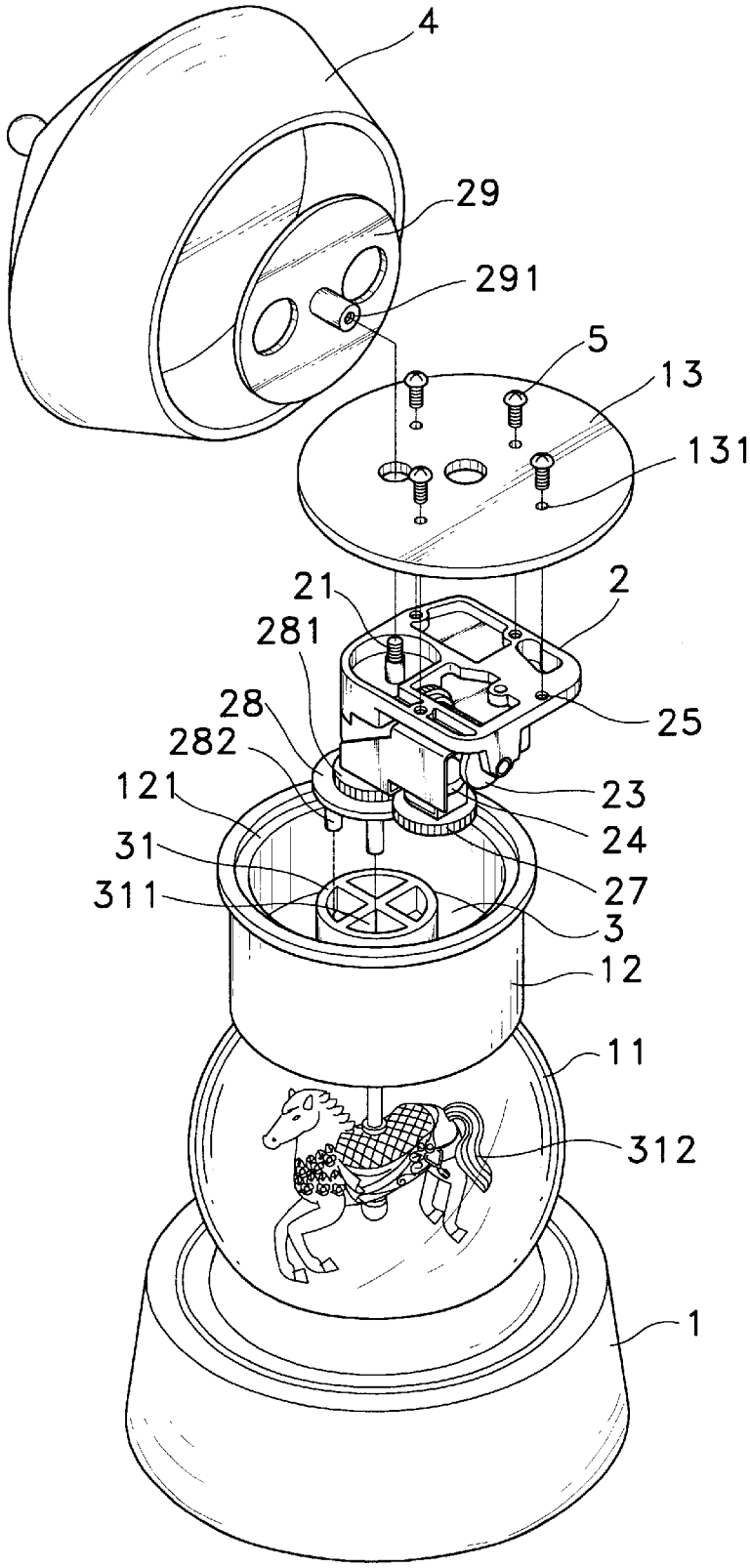
FIG. 2 is an exploded perspective view of this invention.
Figure 3:
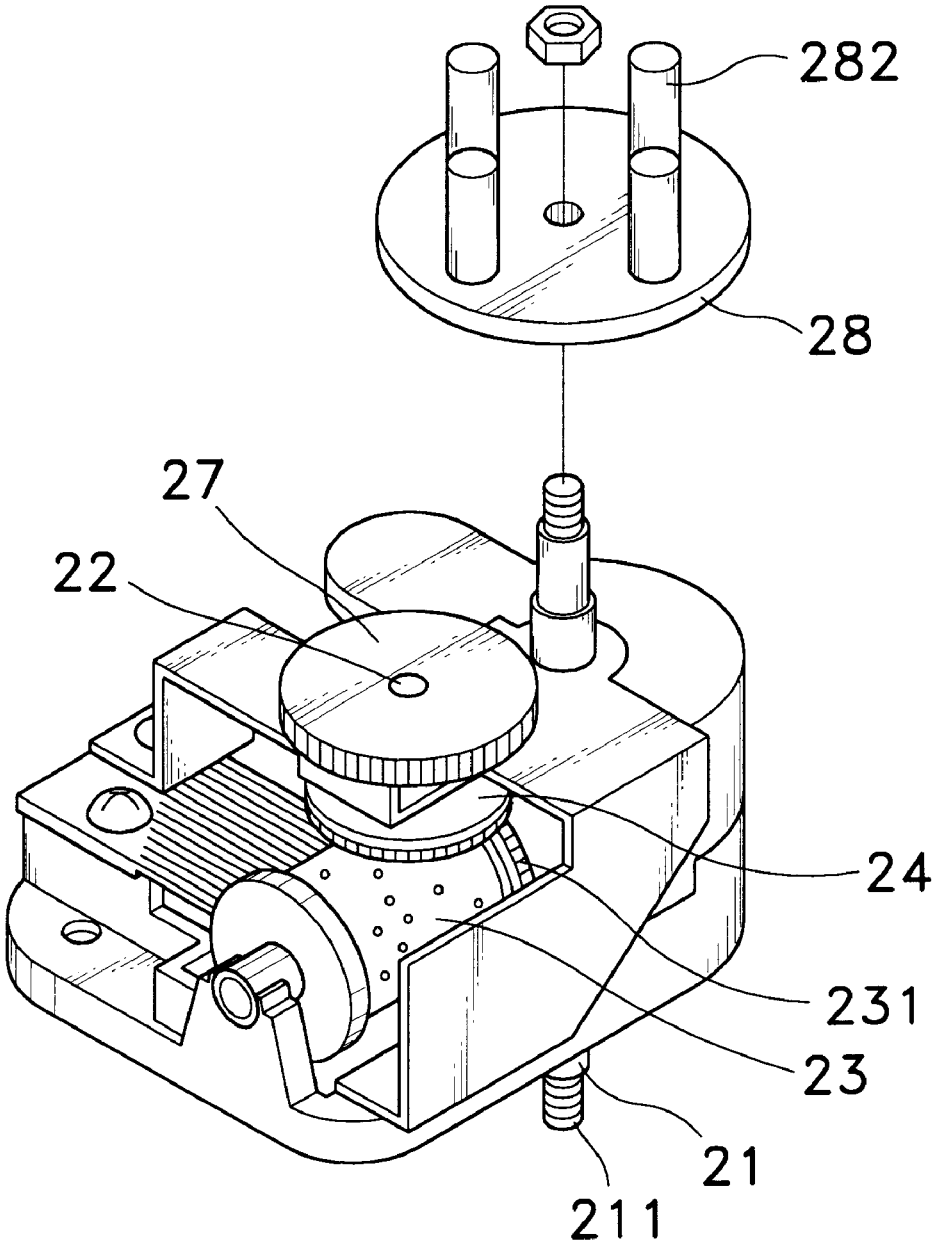
FIG. 3 is an exploded perspective view of a musical kit of this invention.

Referring to FIGS. 2 and 3, the music box according to this invention includes a base 1, a musical kit 2, a seal cap 3 and a rotational upper cap 4. There is a glass ball 11 mounting on the top of the base 1. The glass ball 11 has a top opening surrounded by a hollow tube type frame 12 which has an annular sinking rim 121 on the top for supporting a holding board 13. The holding board 13 has a plurality of through bores 131 formed therein. The glass ball 11 is filled with liquid inside. The seal cap 3 covers the top opening and is sealed with water resistant silicon rubber to make the glass ball 11 water tight once filled. There is a rotational frame 31 located in the center of the seal cap 3. In the rotational frame 31, there are a plurality of cavities 311 opening upward. A rotationable ornament 312 is suspended in the glass ball 11 and attached to the bottom of the rotational frame 31.

Figure 4:
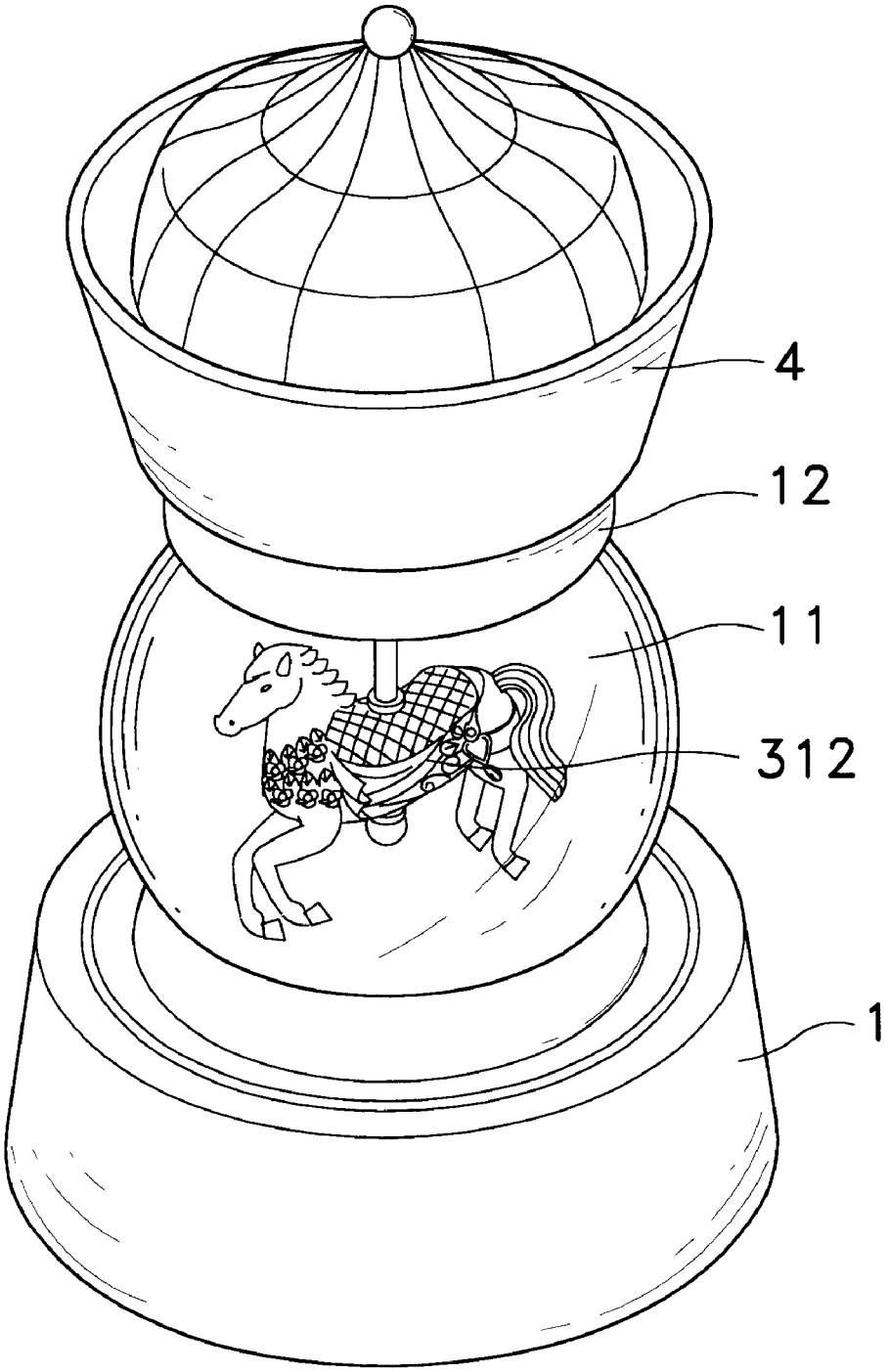
FIG. 4 is a perspective view of this invention.
Figure 5:
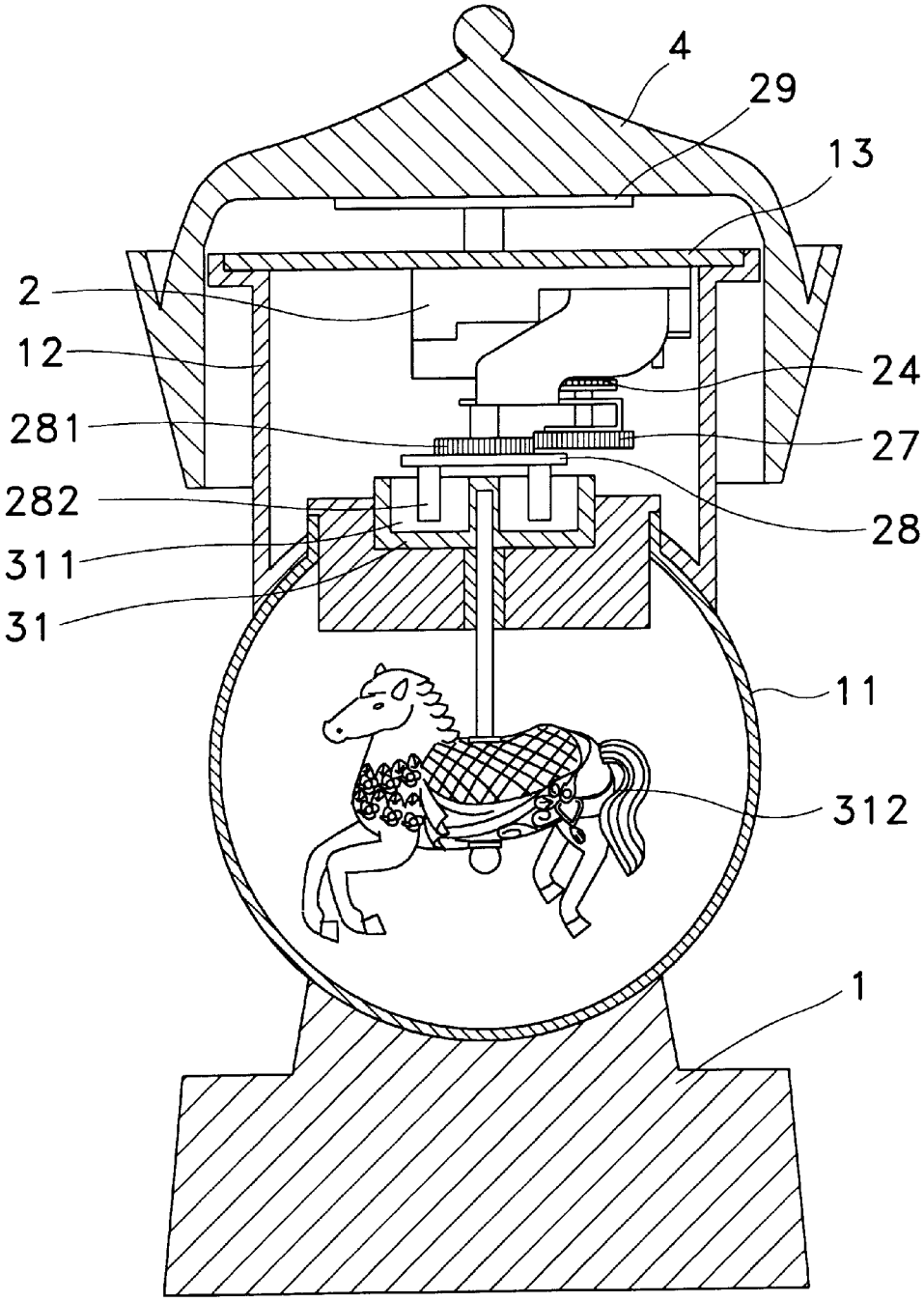
FIG. 5 is a sectional view of this invention.

The musical kit 2 includes a spring shaft 21, a spindle 22, a barrel 23, a second gear 24, a rotation disk 29 and a plurality of first screw bores 25. The spring shaft 21 has screw threads 211 formed at one end for engaging with a second screw bore 291 located at the center of the disk 29. The second gear 24 attaches to one end of the spindle 22 which has another end attaches a third gear 27. The second gear 24 engages with a first gear 231 axially located at one end of the barrel 23. There is a driving member 28 which has an fourth gear 281 located at one side thereof engageable with the third gear 27. At another side of the driving member 28, there are a plurality of struts 282 engageable with the cavities 311. When assembled, screws 5 run through the through bores 131 and first screw bores 25 to engage the musical kit 2 securely on the holding board 13. The struts 282 engage with the cavities 311. The screw threads 211 of the spring shaft 21 engage with the second screw bore 291. The upper cap 4 is fixedly mounted on the disk 29 (also referring to FIG. 4).

When in use, the user may turn the upper cap 4 by hand to wind the spring in the musical kit 2. Once the user's hand is released, the barrel 23 is driven by the spring and rotates to produce music. The first gear 231 drives the second gear 24 and the third gear 27 which in turn drives the driving member 28 through the fourth gear 281. The rotational frame 31 is driven and rotates concurrently. The ornament 312 then will be rotated in the glass ball 11. In the mean time, the spring shaft 21 will rotate in a direction opposite to the ornament 312. The disk 29 and the upper cap 4 thus will also be rotated in opposite direction against the ornament 312. It thus creates two rotating decks turning at opposite direction while music is playing. A more amusing visual and audio effect thus may be produced.

Since the spring shaft 21 is engaged with the upper cap 4, turning the upper cap 4 may produce the rotation and music desired without turning over the base 1. It is simpler and safer to operate than the conventional music box.

What is claimed is:

1. A double deck rotational music box display device having a base and comprising:

a) a glass ball mounted on the base, the glass ball having a top opening;

b) a hollow tube frame mounted on the glass ball so as to cover the top opening, the hollow tube frame having a decorative ornament rotatably mounted thereon such that the decorative ornament is located in the glass ball;

c) a holding board mounted on an upper portion of the hollow tube frame;

d) a music box mechanism mounted on the holding board and located within the hollow tube frame, the music box mechanism including a rotatable barred with a first gear, a second gear engaging the first gear and driving a transmission mechanism connected to the decorative ornament, such that rotation of the rotatable barred rotates the decorative ornament in a first direction, and a spring shaft which rotates in a second direction, opposite to the first direction, as the barred rotates; and, e) an upper cap connected to the spring shaft so as to rotate therewith such that the upper cap rotates in the second direction as the decorative ornament rotates in the first direction.

2. The double deck rotational music box of claim 1 wherein the transmission mechanism comprises:

a) a third gear mounted on a spindle rotated by the second gear;

b) a fourth gear mounted on a driving member and engaged with the third gear; and, c) a rotational frame connected to the decorative ornament so as to rotate therewith and engaging the driving member.

3. The double deck rotational music box of claim 2 and further comprising a plurality of cavities in the rotational frame and a plurality of struts extending from the driving member into engagement with the plurality of cavities.

* * * * *